US008955479B2

(12) United States Patent
Shinomiya

(10) Patent No.: US 8,955,479 B2
(45) Date of Patent: Feb. 17, 2015

(54) VARIABLE VALVE TIMING CONTROL APPARATUS OF INTERNAL COMBUSTION ENGINE AND METHOD FOR ASSEMBLING THE SAME

(71) Applicant: Hitachi Automotive Systems, Ltd., Hitachinaka-shi, Ibaraki (JP)

(72) Inventor: Toru Shinomiya, Atsugi (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 14/109,105

(22) Filed: Dec. 17, 2013

(65) Prior Publication Data

US 2014/0202405 A1 Jul. 24, 2014

(30) Foreign Application Priority Data

Jan. 21, 2013 (JP) ..... 2013-007999

(51) Int. Cl.
*F01L 1/34* (2006.01)
*F01L 1/344* (2006.01)

(52) U.S. Cl.
CPC ..... *F01L 1/34409* (2013.01)
USPC ..... 123/90.17; 123/90.15; 464/160

(58) Field of Classification Search
USPC ..... 123/90.15, 90.17; 464/160
See application file for complete search history.

(56) References Cited

U.S. PATENT DOCUMENTS 7,240,650 B2 7/2007 Imaizumi et al.
8,689,748 B2 * 4/2014 Watanabe ..... 123/90.17
2005/0115528 A1 6/2005 Imaizumi et al.

FOREIGN PATENT DOCUMENTS

JP 2005-155346 A 6/2005

* cited by examiner

*Primary Examiner* — Ching Chang
(74) *Attorney, Agent, or Firm* — Foley & Lardner LLP

(57) ABSTRACT

A variable valve timing control apparatus has a housing; a vane rotor relatively rotating with respect to the housing; a torsion spring always forcing the vane rotor in one rotation direction with respect to the housing; and a spring guide accommodating therein the torsion spring. At least a part of an outside diameter of the torsion spring, before being installed inside the spring guide, is formed to be greater than an inside diameter of an inner wall of the spring guide. In a free state of the torsion spring, after being installed inside the spring guide, in which an urging force of the torsion spring acting on the vane rotor becomes smallest, the outside diameter of the torsion spring is substantially same as the inside diameter of the inner wall of the spring guide or is smaller than the inside diameter of the inner wall of the spring guide.

8 Claims, 5 Drawing Sheets

VARIABLE VALVE TIMING CONTROL APPARATUS OF INTERNAL COMBUSTION ENGINE AND METHOD FOR ASSEMBLING THE SAME

BACKGROUND OF THE INVENTION

The present invention relates to a variable valve timing control apparatus of an internal combustion engine, which variably controls open and closing timing of an intake valve and/or an exhaust valve of the engine in accordance with an engine operating condition, and relates to a method for assembling the variable valve timing control apparatus.

A generally used vane type variable valve timing control apparatus is configured so that, in a state in which an application force by a hydraulic pressure does not act on the variable valve timing control apparatus upon stop of the engine, a vane rotor is relatively rotated to a retarded angle side with respect to a timing sprocket due to an alternating torque occurring at a camshaft.

However, in some variable valve timing control apparatuses, it is required that the valve timing upon stop of the engine, namely a position of the vane rotor upon stop of the engine, be an advanced angle position with respect to a most-retarded angle position. To meet this requirement, a related art has suggested that the vane rotor be forced in an advanced angle direction with respect to a housing by a spring force of a torsion spring.

For instance, in Japanese Patent Provisional Publication No. 2005-155346 (hereinafter is referred to as "JP2005-155346"), one end of the torsion spring is engaged with and fixed in a retaining groove that is formed on an end surface of the vane rotor, while the other end of the torsion spring is held by a retaining portion that is provided at the housing.

Further, at an outer circumferential side of the torsion spring, in order that the torsion spring does not easily come out when twisted in a diameter-reducing direction (in a direction that reduces a diameter of the torsion spring) after its installation, a cylindrical spring guide that extends from the vane rotor in an axial direction is provided.

Regarding assembly of a variable valve timing control apparatus in JP2005-155346, after each component or parts of the variable valve timing control apparatus is installed and assembled, the torsion spring is finally installed. Thus, the number of assembly process that takes place against an urging force (the spring force) of the torsion spring can be reduced to a minimum.

SUMMARY OF THE INVENTION

In the variable valve timing control apparatus in JP2005-155346, however, an outside diameter of the torsion spring in a free state before its installation is formed to be smaller than an inside diameter of the spring guide. Therefore, in a case where the vane rotor relatively rotates to the retarded angle side with respect to the housing against the urging force of the torsion spring, when the torsion spring is twisted (or deformed) in the diameter-reducing direction, this diameter-reduction twisting amount becomes large. Because of this, a gap between an outer circumferential surface of the torsion spring and an inner circumferential surface of the spring guide widens and the torsion spring tilts inside the spring guide. For this reason, there is a possibility that one end or the other end of the torsion spring will be easily come out from the retaining groove or the retaining portion.

It is therefore an object of the present invention to provide a variable valve timing control apparatus of the internal combustion engine, which is capable of suppressing the tilt of the torsion spring when the vane rotor relatively rotates with respect to the housing.

According to one aspect of the present invention, a variable valve timing control apparatus of an internal combustion engine, comprises: a housing to which a turning force is transmitted from an engine crankshaft and which has shoes on an inner circumferential surface of the housing; a vane rotor having (a) a rotor secured to a camshaft and (b) vanes defining an advance working chamber and a retard working chamber between the adjacent two shoes, the vane rotor relatively rotating to an advanced angle side and to a retarded angle side with respect to the housing by selectively supplying/discharging working fluid to/from the advance working chamber and the retard working chamber; a torsion spring always forcing the vane rotor in one rotation direction with respect to the housing by a retaining configuration in which one end of the torsion spring is retained by the vane rotor and the other end of the torsion spring is retained by the housing, the torsion spring being shrunk when the vane rotor relatively rotates with respect to the housing; and a spring guide accommodating therein at least a part, in an axial direction, of the torsion spring, and at least a part of an outside diameter of the torsion spring, before being installed inside the spring guide, is formed to be greater than an inside diameter of an inner wall of the spring guide, and in a free state of the torsion spring, after being installed inside the spring guide, in which an urging force of the torsion spring acting on the vane rotor with respect to the housing becomes smallest, the outside diameter of the torsion spring is substantially same as the inside diameter of the inner wall of the spring guide or is smaller than the inside diameter of the inner wall of the spring guide.

According to another aspect of the present invention, a variable valve timing control apparatus of an internal combustion engine, comprises: a drive rotary member to which a turning force is transmitted from an engine crankshaft; a driven rotary member secured to a camshaft and defining an advance working chamber and a retard working chamber between the driven rotary member and the drive rotary member, the driven rotary member being configured to convert a relative rotational angle of the driven rotary member with respect to the drive rotary member to an advanced angle side by supplying working fluid to the advance working chamber and discharging the working fluid from the retard working chamber and also to convert the relative rotational angle of the driven rotary member to a retarded angle side by supplying the working fluid to the retard working chamber and discharging the working fluid from the advance working chamber; a torsion spring always forcing the driven rotary member in one rotation direction with respect to the drive rotary member by a retaining configuration in which one end of the torsion spring is retained by the driven rotary member and the other end of the torsion spring is retained by the drive rotary member, the torsion spring being shrunk when the driven rotary member relatively rotates with respect to the drive rotary member; and a spring guide accommodating therein at least a part, in an axial direction, of the torsion spring, and at least a part of an outside diameter of the torsion spring, before being installed inside the spring guide, is formed to be greater than an inside diameter of an inner wall of the spring guide, and in a state in which the torsion spring is installed inside the spring guide and an urging force of the torsion spring acting on the driven rotary member with respect to the drive rotary member becomes smallest, the outside diameter of the torsion spring is substantially same as the inside diameter of the inner wall of the spring guide or is smaller than the inside diameter of the inner wall of the spring guide.

According to a further aspect of the invention, a method for assembling a variable valve timing control apparatus of an internal combustion engine, the variable valve timing control apparatus having a housing to which a turning force is transmitted from an engine crankshaft and which has shoes on an inner circumferential surface of the housing; a vane rotor having (a) a rotor secured to a camshaft and (b) vanes defining an advance working chamber and a retard working chamber between the adjacent two shoes, the vane rotor relatively rotating to an advanced angle side and to a retarded angle side with respect to the housing by selectively supplying/discharging working fluid to/from the advance working chamber and the retard working chamber; a torsion spring always forcing the vane rotor in one rotation direction with respect to the housing by a retaining configuration in which one end of the torsion spring is retained by the vane rotor and the other end of the torsion spring is retained by the housing, the torsion spring being shrunk when the vane rotor relatively rotates with respect to the housing; and a spring guide accommodating therein at least a part, in an axial direction, of the torsion spring, the method comprises: fixing the torsion spring whose outside diameter is greater than an inside diameter of an inner wall of the spring guide to a jig; inserting the torsion spring into the spring guide with the torsion spring twisted in a direction in which the outside diameter of the torsion spring becomes smaller; and detaching the jig from the torsion spring while engaging the one end of the torsion spring with the vane rotor and engaging the other end of the torsion spring with the housing.

The other objects and features of this invention will become understood from the following description with reference to the accompanying drawings.

DETAILED DESCRIPTION OF THE INVENTION

According to the present invention, it is possible to suppress the tilt of the torsion spring when the vane rotor relatively rotates with respect to the housing and the torsion spring is twisted (or deformed) in the diameter-reducing direction.

Embodiments of a variable valve timing control apparatus of the present invention will be explained below with reference to the drawings. In the following description, the variable valve timing control apparatus (VTC) is applied to a variable valve system for an exhaust valve side of an internal combustion engine.

First Embodiment

Figure 1:
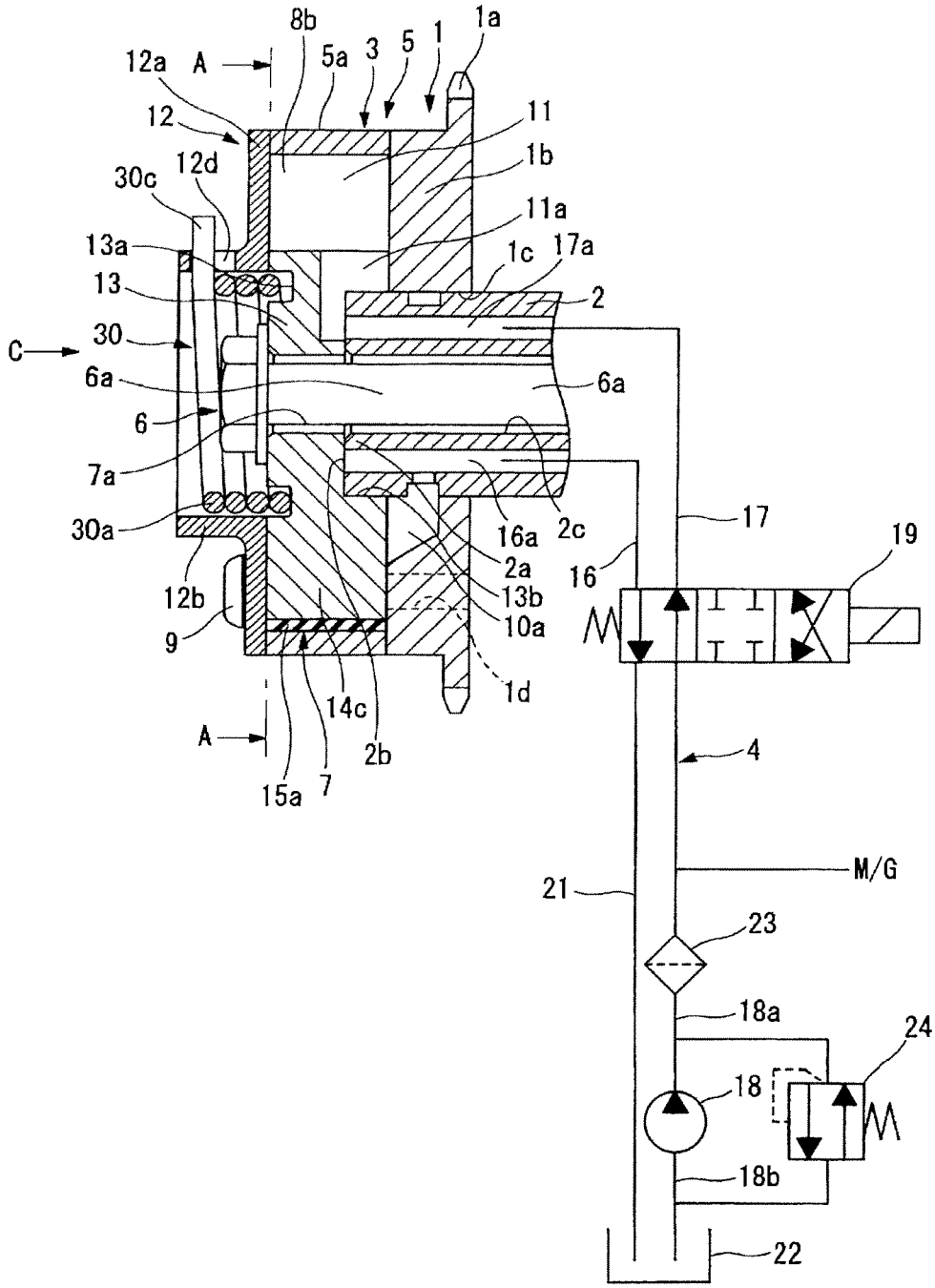
FIG. 1 is a general block diagram of a first embodiment, which is a sectional view, viewed from a B-B line of FIG. 2.
Figure 2:
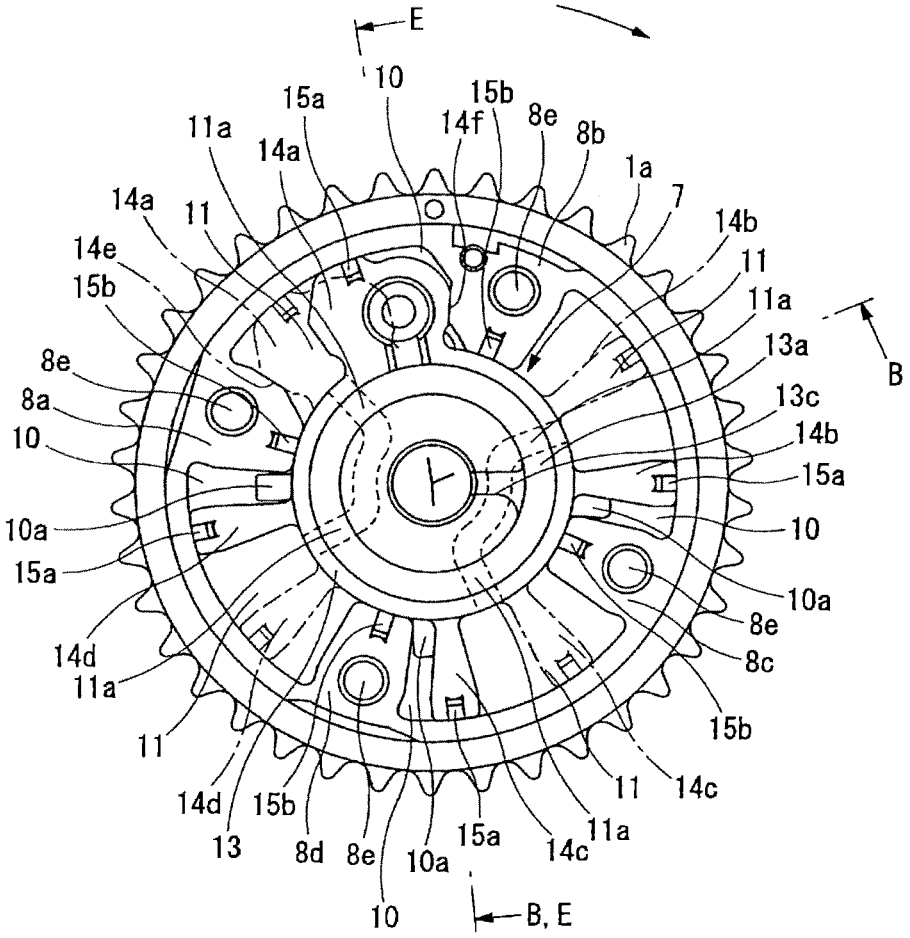
FIG. 2 is a diagram showing a state in which a vane rotor relatively rotates to a most-advanced angle position (a position of a most-advanced angle phase), which is a sectional view, viewed from an A-A line of FIG. 1.
Figure 3:
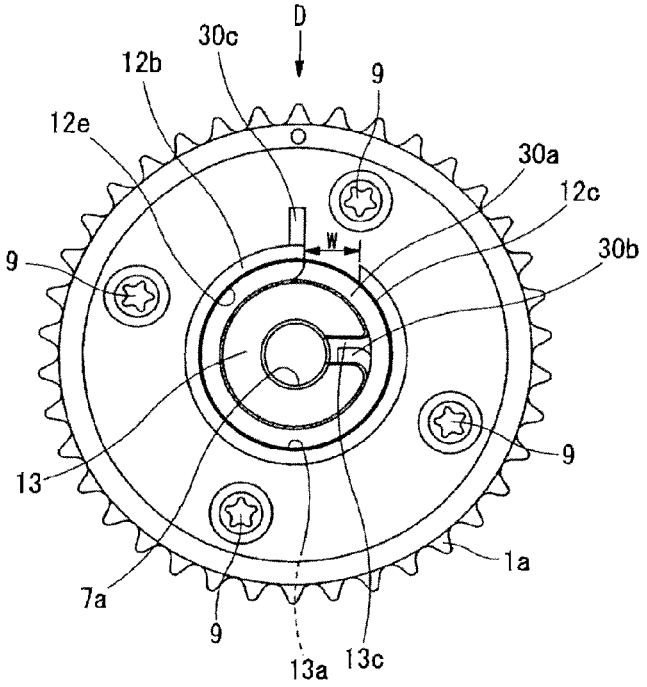
FIG. 3 is a diagram viewed from an arrow C of FIG. 1.

As shown in FIGS. 1 and 2, an exhaust side variable valve timing control apparatus has a sprocket 1 as a drive rotary member which is driven by an engine crankshaft (not shown) by a turning force transmitted through a timing chain, a camshaft 2 which is capable of rotating relative to the sprocket 1, a relative angular phase control mechanism (simply, a phase converter or a phase-change mechanism) 3 disposed between the sprocket 1 and the camshaft 2 and changing or controlling a relative rotational phase between the sprocket 1 and the camshaft 2, and a hydraulic circuit 4 which actuates the phase-change mechanism 3.

The sprocket 1 is formed into a thick disk shape. The sprocket 1 has, at an outer periphery thereof, a gear wheel (or a toothed wheel) 1*a* around which the timing chain is wound and a rear cover 1*b* which serves to cover a rear end opening of an after-mentioned housing 5. The sprocket 1 also has, in the middle thereof, a penetration supporting hole 1*c* through which the sprocket 1 is rotatably supported by an outer periphery of the camshaft 2. Further, four female thread holes 1*d* into which after-mentioned four bolts 9 are screwed respectively are formed at almost regular intervals in a circumferential direction on an outer peripheral area of the sprocket 1.

The camshaft 2 is rotatably supported by a cylinder head (not shown) through a camshaft bearing. The camshaft 2 has a plurality of driving cams (rotation cams), each of which actuates an exhaust valve. Each driving cam is formed integrally with the camshaft 2 at a certain position in an axial direction on an outer peripheral surface of the camshaft 2. Further, the camshaft 2 is provided with a bolt insertion hole 2*c* in the axial direction at an inner side of one end portion 2*a* in order for a shaft portion 6*a* of a cam bolt 6 to screw in. Then, a female thread into which a top end male screw of the cam bolt 6 is screwed is formed at a top end portion of the bolt insertion hole 2*c*. An after-mentioned vane rotor 7 is secured to a top end portion 2*b* of the camshaft 2 from the axial direction by the cam bolt 6.

The phase-change mechanism 3 has, as shown in FIGS. 1 and 2, the housing 5 connected to the sprocket 1 from the axial direction and having working chambers inside the housing 5, the vane rotor 7 as a driven rotary member secured to the one end portion 2*a* of the camshaft 2 by the cam bolt 6 and relatively rotatably housed in the housing 5, four shoes 8 (first to fourth shoes 8*a* to 8*d*) formed integrally with an inner circumferential surface of the housing 5, four retard oil chambers 10 that are retard working chambers and four advance oil chambers 11 that are advance working chambers. These oil chambers are defined by the vane rotor 7 in the housing 5.

The housing 5 is formed by a sintered metal cylindrical housing main body 5*a*, an iron base metal front cover 12 that is formed by pressing and closes a front end opening of the housing main body 5*a* and the sprocket 1 as the rear cover 1*b* that covers the rear end opening of the housing 5. These housing main body 5*a*, front cover 12 and sprocket 1 are tightened together by the four bolts 9 that penetrate the respective bolt insertion holes 8*e* of the four shoes 8, then fixedly connected together.

As shown in FIGS. 1, 3 to 5, the front cover 12 has a disk-shaped body 12*a* and a cylindrical spring guide 12*b* that is formed integrally with the body 12*a* in the middle of the body 12*a*.

The body 12*a* is provided, at regular intervals in a circumferential direction on an outer peripheral area thereof, with four bolt insertion holes (not shown) into which the respective bolts 9 are inserted.

Figure 4:
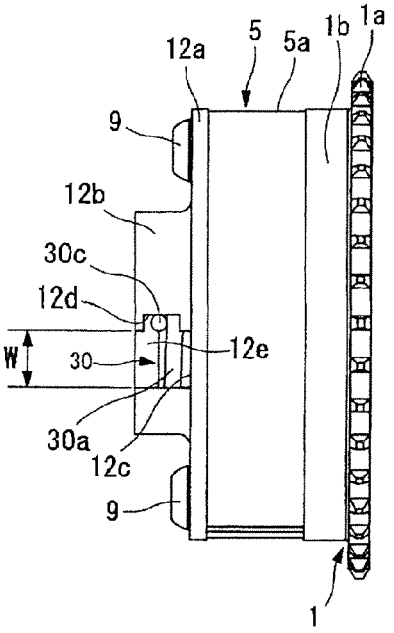
FIG. 4 is a diagram viewed from an arrow D of FIG. 3.

The spring guide 12*b* has a predetermined length and protrudes forward from a front surface of the body 12*a*. As can be seen in FIG. 4, a cutting groove 12*c* is formed along an axial direction at a certain position in a circumferential direction of the cylindrical spring guide 12*b*. This cutting groove 12*c* has a predetermined groove width W in the circumferential direction, and a recessed stopper groove 12*d* is formed on one of opposing surfaces that face each other in the circumferential direction.

In addition, a guide surface 12*e* is formed on an inner wall of the spring guide 12*b*, and an after-mentioned torsion spring 30 is accommodated inside the guide surface 12*e*.

The vane rotor 7 is formed as an integral member by metal material. As shown in FIGS. 1 and 2, the vane rotor 7 has a rotor 13 and four vanes (first to fourth vanes) 14*a* to 14*d*. The rotor 13 is secured to the camshaft 2 from the axial direction by the cam bolt 6 inserted into an insertion hole 7*a* that is formed in the middle of the vane rotor 7. The four vanes 14*a* to 14*d* are arranged at almost regular intervals of 90° in a circumferential direction on an outer circumferential surface of the rotor 13, and protrude in a radial direction.

The rotor 13 is formed into a substantially cylindrical shape. The rotor 13 has, at an outer periphery on a front end surface thereof, a ring-shaped groove 13*a* that is a circular hollow portion, and also has, at a rear end side thereof, a circular fitting groove 13*b* to which the top end portion 2*b* of the camshaft 2 is fitted. On an inner circumferential surface of the ring-shaped groove 13*a*, a stopper groove 13*c* that is cut toward a shaft center direction of the insertion hole 7*a* (i.e. in the radial direction) is formed.

As shown in FIG. 2, each of the first to fourth vanes 14*a* to 14*d* is placed between the adjacent two shoes of the shoes 8*a* to 8*d*. A seal groove is formed on an arc-shaped outer peripheral surface of each vane, and a seal member 15*a* is fitted in the seal groove. Each seal member 15*a* of the vane has the same width in the circumferential direction, and seals a gap between the outer peripheral surface of the vane and an inner circumferential surface of the housing main body 5*a* while making sliding contact with the inner circumferential surface of the housing main body 5*a*.

On the other hand, a seal groove is formed on a top end inner peripheral surface of each shoe 8 (the first to fourth shoes 8*a* to 8*d*), and a seal member 15*b* is fitted in the seal groove. Each seal member 15*b* seals a gap between the top end inner peripheral surface of the shoe 8 and the outer circumferential surface of the rotor 13 while making sliding contact with the outer circumferential surface of the rotor 13.

The vane rotor 7 is configured so that when the vane rotor 7 relatively rotates to a most-retarded angle side, as shown by a dashed line in FIG. 2, one side surface 14*e* of the first vane 14*a* touches an opposing side surface of the first shoe 8*a* which faces the one side surface 14*e* in the circumferential direction, then a rotation position at the most-retarded angle side of the vane rotor 7 is limited. Likewise, the vane rotor 7 is configured so that when the vane rotor 7 relatively rotates to a most-advanced angle side, as shown by a solid line in FIG. 2, the other side surface 14*f* of the first vane 14*a* touches an opposing side surface of the second shoe 8*b* which faces the other side surface 14*f* in the circumferential direction, then a rotation position at the most-advanced angle side of the vane rotor 7 is limited.

These first vane 14*a*, first and second shoes 8*a* and 8*b* serve as a stopper that limits the most-retarded angle position and the most-advanced angle position of the vane rotor 7.

At this time (when the vane rotor 7 is positioned at the most-retarded angle position or the most-advanced angle position), with regard to the other vanes (the second to fourth vanes) 14*b* to 14*d*, both side surfaces of each vane do not touch the respective opposing surfaces of the shoes 8*a* to 8*d* which face the side surface of the second to fourth vanes 14*b* to 14*d* respectively in the circumferential direction, namely that the second to fourth vanes 14*b* to 14*d* are in a no-contact state with each shoe 8. Therefore, contact accuracy of the first vane 14*a* and the first and second shoes 8*a* and 8*b* is improved. In addition, a supply speed of hydraulic pressure to each of the oil chambers 10 and 11 increases, thereby improving a forward/backward rotation response of the vane rotor 7.

Each of the retard oil chambers 10 and each of the advance oil chambers 11 communicate with the hydraulic circuit 4 through a first communication hole 10*a* and a second communication hole 11*a* that are formed along a radial direction at an inside of the rotor 13.

The hydraulic circuit 4 selectively supplies working fluid (the hydraulic pressure) in each of the retard and advance oil chambers 10 and 11 or discharges the oil supplied in the retard and advance oil chambers 10 and 11. As shown in FIG. 1, the hydraulic circuit 4 has a retard oil passage 16 that supplies/discharges the hydraulic pressure to/from each retard oil chamber 10 through the first communication hole 10*a*, an advance oil passage 17 that supplies/discharges the hydraulic pressure to/from each advance oil chamber 11 through the second communication hole 11*a*, an oil pump 18 that supplies the working fluid to the oil passages 16 and 17 as a fluid pressure supply, and an electromagnetic switching valve 19 that switches a fluid passage of the retard oil passage 16 and the advance oil passage 17 in accordance with an engine operating condition.

The oil pump 18 is a generally used pump such as a trochoid pump that is driven by the engine crankshaft.

Each one end portion of the retard oil passage 16 and the advance oil passage 17 is connected to a passage port of the electromagnetic switching valve 19. Regarding the other end portion sides of the retard oil passage 16 and the advance oil passage 17, a retard oil passage portion 16*a* and an advance oil passage portion 17*a* are formed at an inside of the camshaft 2 with these oil passage portions 16*a* and 17*a* extending parallel to each other (parallel to the camshaft 2) in the axial direction through the cylinder head and/or a cylinder block (both not shown).

The retard oil passage portion 16*a* communicates with each retard oil chamber 10 through the first communication hole 10*a*, while the advance oil passage portion 17*a* communicates with each advance oil chamber 11 through the second communication hole 11*a*.

As shown in FIG. 1, the electromagnetic switching valve 19 is a two-position three-port valve. The electromagnetic switching valve 19 is configured to connect an oil outlet passage 18*a* of the oil pump 18 and either one of the oil passage 16 or 17 and also connect an oil drain passage 21 and the other of the oil passages 16 and 17 at the same time, by backward-and-forward motion of a spool valve body (not shown) that is provided slidably in an axial direction inside a valve body of the electromagnetic switching valve 19 by an electronic controller (not shown).

An oil inlet passage 18*b* of the oil pump 18 and the oil drain passage 21 each communicate with an oil pan 22. A filter 23 is provided at a downstream side of the oil outlet passage 18*a* of the oil pump 18, and a downstream side of the filter 23 communicates with a main oil gallery M/G that supplies lubricant to sliding parts in the engine. Further, the oil pump 18 is provided with an oil flow amount control valve 24 that controls the oil flow amount to a proper amount by discharging surplus working fluid that flows from the oil pump 18 to the oil outlet passage 18*a* to the oil pan 22.

The electronic controller has a computer, and inputs information signals from sensors such as a crank angle sensor, an airflow meter, an engine temperature sensor, a throttle valve opening sensor and a cam angle sensor that detects a current rotation phase of the camshaft 2 (all not shown), and detects a current engine operating condition. Further, the electronic controller outputs a control pulse current to an electromagnetic coil of the electromagnetic switching valve 19, and performs the switching control of each oil passage by controlling a position of the spool valve body (the motion of the spool valve body).

Figure 5:
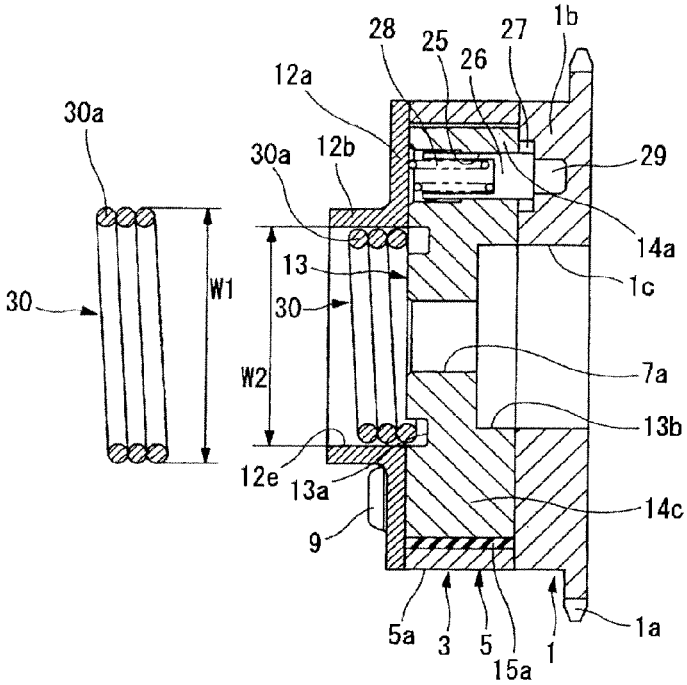
FIG. 5 is a sectional view, viewed from an E-E line of FIG. 2, and a vertically-cut cross section of a torsion spring that is in a free state before its installation.

As shown in FIG. 5, between the first vane 14*a* and the rear cover 1*b* of the sprocket 1, a locking mechanism that restrains free rotation of the vane rotor 7 with respect to the housing 5 and locks the vane rotor 7 to the most-advanced angle position is provided.

This locking mechanism has a lock pin 26 slidably housed or held in a sliding hole 25 that is formed at and penetrates the first vane 14*a* in an axial direction and freely moving toward or away from the rear cover 1*b* side, a locking hole 27 formed at a substantially middle position in a radial direction of the rear cover 1*b* and receiving therein a top end portion 26*a* of the lock pin 26 for engagement (for the lock of the vane rotor 7) or releasing therefrom the top end portion 26*a* for disengagement (for release of the lock of the vane rotor 7), and a locking/releasing mechanism engaging and disengaging the top end portion 26*a* of the lock pin 26 with and from the locking hole 27 in accordance with an engine start condition.

A shape of the lock pin 26 including the top end portion 26*a* is a substantially cylindrical shape by which the lock pin 26 can easily engages with the locking hole 27 from the axial direction. A coil spring 28 is provided between a hollow bottom of the lock pin 26, which is formed at an inside of the lock pin 26 from a rear end side of the lock pin 26 in the axial direction, and an inner surface of the front cover 12, then forces the lock pin 26 in a forward direction (in an engagement direction).

The locking hole 27 has a diameter that is greater than an outside diameter of the top end portion 26*a* of the lock pin 26, and is positioned, in the circumferential direction, at the retard oil chamber 10 side. This position is set so that when the lock pin 26 is engaged with the locking hole 27, a relative rotational angle position (a relative conversion angle position) between the housing 5 and the vane rotor 7 is the most-advanced angle side position.

Further, a cylindrical pressure-receiving space 29 whose diameter is smaller than an outside diameter of the lock pin 26 is formed at a position which is deeper than the locking hole 27 in the axial direction.

The locking/releasing mechanism has the coil spring 28 forcing the lock pin 26 in the forward direction (in the engagement direction) and a lock cancelling hydraulic circuit (not shown) that supplies a hydraulic pressure to the pressure-receiving space 29 in the locking hole 27 and moves the lock pin 26 in a backward direction (in a disengagement direction). This lock cancelling hydraulic circuit is configured so that a hydraulic pressure selectively supplied to the retard oil chamber 10 and the advance oil chamber 11 is supplied to the pressure-receiving space 29 through a certain oil hole then the lock pin 26 moves in the backward direction (in the disengagement direction).

The torsion spring 30 that forces the vane rotor 7 in an advanced angle direction with respect to the housing 5 is installed inside the spring guide 12*b*.

As shown in FIGS. 1, 3 to 5, the torsion spring 30 has a coiled spring body 30*a*, a first stopper portion 30*b* that is formed by bending one end of the spring body 30*a* in a radially inward direction and projects in the radially inward direction, and a second stopper portion 30*c* that is formed by bending the other end of the spring body 30*a* in a radially outward direction and projects in the radially outward direction.

Most of the spring body 30*a* is accommodated inside the spring guide 12*b*, and a part of the spring body 30*a*, which is on an axial direction inner side, is accommodated in and fitted to the ring-shaped groove 13*a* of the rotor 13.

The first stopper portion 30*b* is retained by or fixed to the stopper groove 13*c* of the rotor 13. The second stopper portion 30*c* is retained by or fixed to the recessed stopper groove 12*d* of the front cover 12. With this setting, the vane rotor 7 is always forced in the advanced angle side rotation direction.

Further, the torsion spring 30 is set so that when the vane rotor 7 relatively rotates to a retarded angle side with respect to the housing 5, the torsion spring 30 is twisted (or deformed) in a diameter-reducing direction (in a direction that reduces a diameter of the torsion spring).

Furthermore, as shown in FIG. 5, an outside diameter W1 of the torsion spring 30 in a free state before being installed inside the spring guide 12*b* is formed to be greater than an inside diameter W2 of the inner wall of the spring guide 12*b* of the front cover 12. Thus, upon installing the torsion spring 30 into the spring guide 12*b*, the outside diameter W1 of the torsion spring 30 is previously shrunk until the outside diameter W1 is the substantially same as the inside diameter W2 of the inner wall of the spring guide 12*b* or is smaller than the inside diameter W2, which is carried out outside the variable valve timing control apparatus (i.e. before setting the torsion spring 30 to the variable valve timing control apparatus).

In a free state of the torsion spring 30 after being installed inside the spring guide 12*b* in which an urging force (a spring force) of the torsion spring 30 acting on the vane rotor 7 becomes smallest, the outside diameter W1 of the torsion spring 30 is the substantially same as the inside diameter W2 of the inner wall of the spring guide 12*b* or smaller than the inside diameter W2. And also, a slight spring load (a set load) is applied to the torsion spring 30.

Here, an assembling method for installing the torsion spring 30 of the variable valve timing control apparatus of the present invention in the spring guide 12*b* will be explained below.

Before installing the torsion spring 30, installation or assembly of each component or parts of the variable valve timing control apparatus is completed, then the torsion spring 30 is finally installed using assembly jigs.

Figure 6:
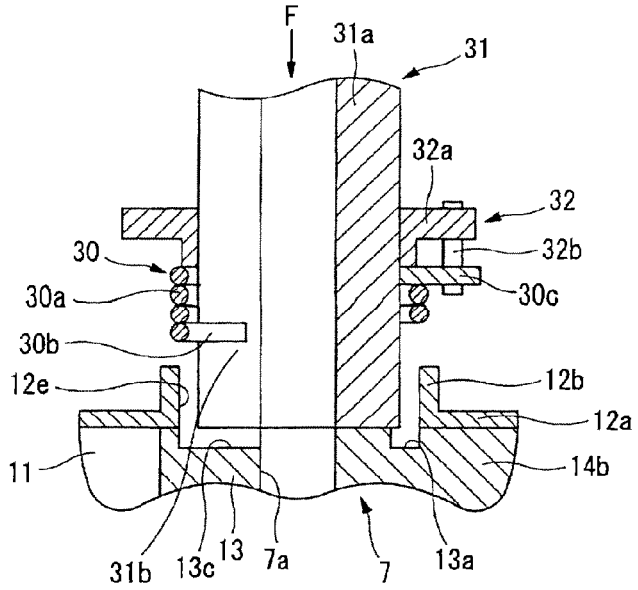
FIG. 6 is a sectional view of a main part, showing an assembly state in which the torsion spring is assembled by assembly jigs.
Figure 7:
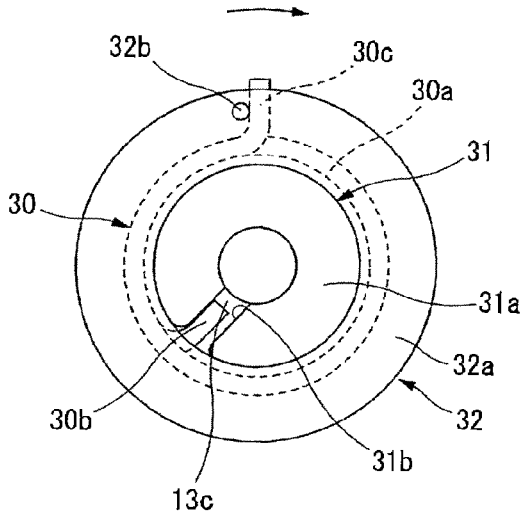
FIG. 7 is a diagram viewed from an arrow F of FIG. 6.
Figure 8:
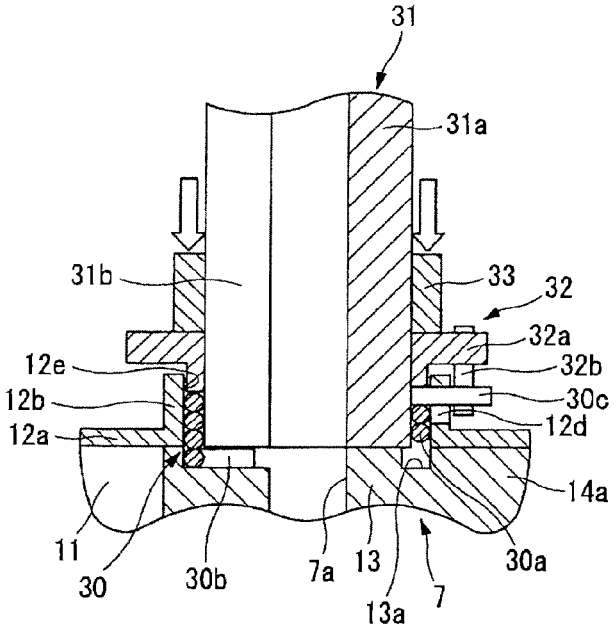
FIG. 8 is a sectional view of a main part, showing an assembly state in which the torsion spring was assembled by assembly jigs.

In this assembling method, as shown in FIGS. 6 to 8, necessary components of the variable valve timing control apparatus are previously fixed on a fixing base (not shown), and the installation of the torsion spring 30 is performed using first to third assembly jigs 31 to 33.

The first assembly jig 31 is formed into a cylindrical shape, and has a long thin guide slit 31*b* that is cut along an axial direction (in an up-and-down direction in FIG. 6).

An outside diameter of the first assembly jig 31 is set to be almost same as an inside diameter of the ring-shaped groove 13*a* of the rotor 13. An inside diameter of the first assembly jig 31 is set to be almost same as an inside diameter of the insertion hole 7*a* of the vane rotor 7.

An outer peripheral surface of the first assembly jig 31 serves as a guide that guides the torsion spring 30 to slide in the axial direction.

The guide slit 31*b* has a substantially same shape as the stopper groove 13*c* of the rotor 13, and the first stopper portion 30*b* of the torsion spring 30 is fitted into this guide slit 31*b*.

The second assembly jig 32 is formed into a cylindrical shape, and has an annular flange portion 32*a* at an outer periphery of the cylindrical shape. Further, a stopper pin 32*b* is provided so as to protrude downward in the axial direction from an outer circumferential portion of the flange portion 32*a*.

The second assembly jig 32 is set on the outer peripheral surface of the first assembly jig 31 so that the second assembly jig 32 can rotate and also slide in the axial direction. As shown in FIG. 7, when the second assembly jig 32 is rotated in an arrow direction, the stopper pin 32*b* contacts the second stopper portion 30*c* of the torsion spring 30 from a circumferential direction.

The third assembly jig 33 has a cylindrical shape, as shown in FIG. 8, and an inner peripheral surface of the third assembly jig 33 is formed so that the third assembly jig 33 can slide in the axial direction on the outer peripheral surface of the first assembly jig 31.

In order to install the torsion spring 30 with the outside diameter W1 of the torsion spring 30 shrunk so as to be smaller than the inside diameter W2 of the spring guide 12*b*, as shown in FIGS. 6 and 7, firstly the first stopper portion 30*b* of the torsion spring 30 is fitted to the guide slit 31*b* of the first assembly jig 31, then the first assembly jig 31 is inserted into an inner circumferential side of the torsion spring 30 from the up-and-down direction.

Secondly, a lower end surface of the first assembly jig 31 is made abut on or joined to an upper surface of an area enclosed with the ring-shaped groove 13*a* of the rotor 13 from the axial direction while adjusting the guide slit 31*b* of the first assembly jig 31 to a position of the stopper groove 13*c* of the rotor 13.

Thirdly, the torsion spring 30 is holed at a position shown in FIG. 6 through the outer peripheral surface of the first assembly jig 31. In this state, the second assembly jig 32 is inserted and fitted onto the first assembly jig 31 from the upper direction. While sliding the second assembly jig 32 on the outer peripheral surface of the first assembly jig 31 in the lower direction, the second assembly jig 32 is set at an axial direction upper position of the torsion spring 30 and also the stopper pin 32*b* is made contact with a side edge of the second stopper portion 30*c* of the torsion spring 30 at the same time. Then, in this state, by rotating the second assembly jig 32 in a direction in which the diameter of the torsion spring 30 becomes smaller (in which the torsion spring 30 is shrunk), i.e. in a direction indicated by an arrow in FIG. 7, the stopper pin 32*b* rotates in the diameter-reducing direction against the spring force of the torsion spring 30. At this time, the torsion spring 30 is shrunk by the rotation of the second assembly jig 32 so that the outside diameter W1 of the torsion spring 30 is the substantially same as the inside diameter W2 of the spring guide 12*b* and also the second stopper portion 30*c* of the torsion spring 30 is positioned within the groove width W of the cutting groove 12*c* of the front cover 12.

Next, as shown in FIG. 8, the third assembly jig 33 is inserted and fitted onto the first assembly jig 31 from the upper direction. While sliding the third assembly jig 33 on the outer peripheral surface of the first assembly jig 31 in the lower direction, the third assembly jig 33 is set at an axial direction upper position of the second assembly jig 32. In this state, by pressing the third assembly jig 33 from the upper direction to a vertically downward direction, while the inner circumference of the torsion spring 30 is being guided by the outer peripheral surface of the first assembly jig 31 through the second assembly jig 32, a lower end of the torsion spring 30 is accommodated in the ring-shaped groove 13*a* of the rotor 13. At the same time, the first stopper portion 30*b* is fitted into and fixed to the stopper groove 13*c* of the rotor 13, and also the second stopper portion 30*c* is fitted into the cutting groove 12*c*.

Subsequently, by rotating the second assembly jig 32 in a diameter-widening direction (in a direction in which the diameter of the torsion spring 30 becomes greater), the second stopper portion 30*c* is fixed to the stopper groove 12*d* of the cutting groove 12*c*, then the torsion spring 30 is installed inside the spring guide 12*b* of the front cover 12.

Finally, by pulling each jig (the jigs 31, 32 and 33) in a vertically upward direction and detaching the jigs 31, 32 and 33, the installation of the torsion spring 30 is completed. With this installation, the torsion spring 30 is brought to the state in which the outside diameter W1 of the torsion spring 30 is the substantially same as the inside diameter W2 of the spring guide 12*b*.

Operation and Effect of First Embodiment

Next, working or operation and effect of the present embodiment will be explained in detail.

At an engine start, as shown in FIG. 2, the vane rotor 7 is forced at the most-advanced angle position by the spring force of the torsion spring 30, and in a state of this position of the vane rotor 7, as shown in FIG. 5, the top end portion 26*a* of the lock pin 26 is previously inserted into and engaged with the locking hole 27. The position of the vane rotor 7 is therefore restrained at the advanced angle side relative rotation position which is suitable for the engine start. Since the valve timing of the exhaust valve is controlled to the most-advanced angle side in this way, during the engine start by turning or pushing an ignition switch, good engine startability can be ensured by the smooth cranking.

When the engine operating condition is, for instance, in a low rotation speed load region after the engine start, no-current application state of the electromagnetic coil of the electromagnetic switching valve 19 is maintained by the electronic controller. With this control, the oil outlet passage 18*a* of the oil pump 18 and the retard oil passage 16 are connected to each other, and also the advance oil passage 17 and the oil drain passage 21 are connected to each other.

The working fluid flowing from the oil pump 18 thus flows into each retard oil chamber 10 through the retard oil passage 16, then each retard oil chamber 10 becomes a high pressure. On the other hand, the working fluid in each advance oil chamber 11 is discharged in the oil pan 22 from the oil drain passage 21 through the advance oil passage 17, then each advance oil chamber 11 becomes a low pressure.

At this time, the working fluid flowing into each retard oil chamber 10 also flows into the pressure-receiving space 29 from the lock cancelling hydraulic circuit and the pressure-receiving space 29 becomes the high pressure. The top end portion 26*a* of the lock pin 26 then moves in the backward direction and comes out of the locking hole 27 (is disengaged with the locking hole 27), thereby allowing the free rotation of the vane rotor 7.

Thus, when the vane rotor 7 rotates to the retarded angle side with increase or expansion of volume of the retard oil chamber 10 as shown by the dashed line in FIG. 2, the one side surface 14*e* of the first vane 14*a* touches (or is pressed against) the opposing side surface of the first shoe 8*a* which faces the one side surface 14*e* in the circumferential direction, the rotation position at the most-retarded angle side of the vane rotor 7 is then limited. With this operation and working, the relative rotational angle (the relative rotational phase) of the camshaft 2 (the vane rotor 7) with respect to the housing 5 is converted to the most-retarded angle side.

Here, since the vane rotor 7 relatively rotates with respect to the housing 5, the torsion spring 30 is twisted (or deformed) in the diameter-reducing direction.

Next, when the engine operating condition is, for instance, in a high rotation speed load region, the controller outputs the control current to the electromagnetic switching valve 19, and the oil outlet passage 18*a* of the oil pump 18 and the advance oil passage 17 are connected to each other, also the retard oil passage 16 and the oil drain passage 21 are connected to each other. With this operation, the working fluid in the retard oil chamber 10 is exhausted in the oil pan 22, then each retard oil chamber 10 becomes the low pressure. On the other hand, the working fluid is supplied to the advance oil chamber 11, then each advance oil chamber 11 becomes the high pressure. At this time, since the working fluid (the hydraulic pressure) is supplied to the locking hole 27 from the advance oil chamber 11 through the lock cancelling hydraulic circuit, a disengagement state in which the lock pin 26 comes out of the locking hole 27 by this hydraulic pressure is maintained.

Thus, when the vane rotor 7 rotates to the advanced angle side with respect to the housing 5 as shown in FIG. 2, the other side surface 14*f* of the first vane 14*a* touches (or is pressed against) the opposing side surface of the second shoe 8*b* which faces the other side surface 14*f* in the circumferential direction, the rotation position at the most-advanced angle side of the vane rotor 7 is then limited. With this operation and working, the relative rotational angle (the relative rotational phase) of the camshaft 2 (the vane rotor 7) with respect to the housing 5 is converted to the most-advanced angle side. As a consequence, open and closing timing of the exhaust valve is controlled to the most-advanced angle side, and an output of the engine in the high rotation speed high load region can be increased.

Further, just before an engine stop, the working fluid (the hydraulic pressure) is exhausted in the oil pan 22 from each of the retard and advance oil chambers 10 and 11 through the oil drain passage 21, and the hydraulic pressure in the pressure-receiving space 29 and the locking hole 27 also decreases. As a result, the vane rotor 7 relatively rotates to the most-advanced angle side by the spring force of the torsion spring 30 which acts on the camshaft 2, and in the state of this position of the vane rotor 7, the lock pin 26 moves in the forward direction by a spring force of the coil spring 28 and the top end portion 26*a* is inserted into and engaged with the locking hole 27.

In this case, since exact positioning, in the circumferential direction, of the housing 5 by the lock pin 26 and the locking hole 27 is achieved when assembling each component, smooth engagement of the lock pin 26 can be ensured.

In the present embodiment, as described above, by the assembling method, the torsion spring 30 having the outside diameter W1 in the free state before its installation is installed. Then, in the free state of the torsion spring 30 after its installation in which the urging force (the spring force) of the torsion spring 30 acting on the vane rotor 7 with respect to the housing 5 is smallest, the outside diameter W1 of the torsion spring 30 is the substantially same as the inside diameter W2 of the spring guide 12*b*.

That is, by the fact that the torsion spring 30 is installed inside the spring guide 12*b* with the torsion spring 30 shrunk, since the torsion spring 30 widens until the outside diameter W1 of the torsion spring 30 is the substantially same as the inside diameter W2 of the spring guide 12*b*, the torsion spring 30 in the free state after its installation can be previously provided with the spring load. With this setting, a diameter-reduction twisting amount, when the relative rotational angle of the vane rotor 7 with respect to the housing 5 is converted to the most-retarded angle side and the torsion spring 30 is twisted (or deformed) in the diameter-reducing direction after the engine start, can be small. Accordingly, a gap appearing between an outer circumferential surface of the torsion spring 30 and an inner circumferential surface of the guide surface 12*e* of the spring guide 12*b* can be as small as possible, and a guiding effect of the guide surface 12*e* on the torsion spring 30 is increased, thereby suppressing the tilt of the torsion spring 30 when twisted in the diameter-reducing direction.

Further, since the tilt of the torsion spring 30 when twisted in the diameter-reducing direction can be suppressed, it is possible to prevent the first stopper portion 30*b* and the second stopper portion 30*c* of the torsion spring 30 from coming out of or disengaged with the stopper groove 13*c* of the rotor 13 and the stopper groove 12*d* of the front cover 12 respectively.

In addition, by the fact that the torsion spring 30 is installed inside the spring guide 12*b* with the torsion spring 30 shrunk, since the torsion spring 30 widens until the outside diameter W1 of the torsion spring 30 is the substantially same as the inside diameter W2 of the spring guide 12*b*, as mentioned above, the gap appearing between the outer circumferential surface of the torsion spring 30 and the inner circumferential surface of the guide surface 12*e* of the spring guide 12*b* can be as small as possible in the free state after the installation of the torsion spring 30. Thus, the guiding effect of the guide surface 12*e*, which suppresses the tilt of the torsion spring 30, is increased when the relative rotational angle of the vane rotor 7 with respect to the housing 5 is converted to the most-retarded angle side and the torsion spring 30 is twisted (or deformed) in the diameter-reducing direction.

Furthermore, since the guiding effect of the guide surface 12*e* is increased, an attitude of the torsion spring 30 when twisted in the diameter-reducing direction can be stabilized. Therefore, a stable urging force of the torsion spring 30 which relatively rotates the vane rotor 7 to the advanced angle side can be obtained.

Moreover, in the present embodiment, no additional or special mechanism is required for preventing the coming out or the disengagement of the first and second stopper portions 30*b* and 30*c* of the torsion spring 30. Thus, increase in a component count and increase in complexity of the parts can be suppressed.

The present invention is not limited to the above embodiment, and the above embodiment can be modified.

From the foregoing, the present invention includes the following structure or configuration of the variable valve timing control apparatus, and has the following effects.

(a) In the variable valve timing control apparatus, a stopper groove is provided on a top end surface of the vane rotor, and the one end of the torsion spring is retained by the stopper groove.

(b) In the variable valve timing control apparatus, the stopper groove is formed toward an inner circumferential side at a protruding portion that protrudes in the spring guide.

(c) In the variable valve timing control apparatus, the spring guide is formed by a recessed portion that is provided at the vane rotor and a cylindrical portion that is provided at the housing.

(d) In the variable valve timing control apparatus, a cutting portion is formed at a part of the cylindrical portion provided at the housing so as to penetrate inner and outer circumferential surfaces of the cylindrical portion, and the other end of the torsion spring is retained by the cutting portion.

(e) In the variable valve timing control apparatus, the torsion spring forces the vane rotor in an advanced angle direction with respect to a rotation direction of the housing, and when the engine stops, the vane rotor stops at a most-advanced angle position by the urging force of the torsion spring.

According to the present invention, since the vane rotor stops at the most-advanced angle position by the urging force of the torsion spring, the good engine startability can be ensured when the engine starts.

The entire contents of Japanese Patent Application No. 2013-007999 filed on Jan. 21, 2013 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable valve timing control apparatus of an internal combustion engine, comprising:

a housing to which a turning force is transmitted from an engine crankshaft and which has shoes on an inner circumferential surface of the housing;

a vane rotor having:

(a) a rotor secured to a camshaft; and (b) vanes defining an advance working chamber and a retard working chamber between the adjacent two shoes, the vane rotor relatively rotating to an advanced angle side and to a retarded angle side with respect to the housing by selectively supplying/discharging working fluid to/from the advance working chamber and the retard working chamber;

a torsion spring always forcing the vane rotor in one rotation direction with respect to the housing by a retaining configuration in which one end of the torsion spring is retained by the vane rotor and the other end of the torsion spring is retained by the housing, the torsion spring being shrunk when the vane rotor relatively rotates with respect to the housing; and a spring guide accommodating therein at least a part, in an axial direction, of the torsion spring, and at least a part of an outside diameter of the torsion spring, before being installed inside the spring guide, being formed to be greater than an inside diameter of an inner wall of the spring guide, and in a free state of the torsion spring, after being installed inside the spring guide, in which an urging force of the torsion spring acting on the vane rotor with respect to the housing becomes smallest, the outside diameter of the torsion spring being substantially same as the inside diameter of the inner wall of the spring guide or being smaller than the inside diameter of the inner wall of the spring guide.

2. The variable valve timing control apparatus of the internal combustion engine as claimed in claim 1, wherein:

a stopper groove is provided on a top end surface of the vane rotor, and the one end of the torsion spring is retained by the stopper groove.

3. The variable valve timing control apparatus of the internal combustion engine as claimed in claim 2, wherein:

the stopper groove is formed toward an inner circumferential side at a protruding portion that protrudes in the spring guide.

4. The variable valve timing control apparatus of the internal combustion engine as claimed in claim 1, wherein:

the spring guide is formed by a recessed portion that is provided at the vane rotor and a cylindrical portion that is provided at the housing.

5. The variable valve timing control apparatus of the internal combustion engine as claimed in claim 4, wherein:

a cutting portion is formed at a part of the cylindrical portion provided at the housing so as to penetrate inner and outer circumferential surfaces of the cylindrical portion, and the other end of the torsion spring is retained by the cutting portion.

6. The variable valve timing control apparatus of the internal combustion engine as claimed in claim 1, wherein:

the torsion spring forces the vane rotor in an advanced angle direction with respect to a rotation direction of the housing, and when the engine stops, the vane rotor stops at a most-advanced angle position by the urging force of the torsion spring.

7. A variable valve timing control apparatus of an internal combustion engine, comprising:

a drive rotary member to which a turning force is transmitted from an engine crankshaft;

a driven rotary member secured to a camshaft and defining an advance working chamber and a retard working chamber between the driven rotary member and the drive rotary member, the driven rotary member being configured to convert a relative rotational angle of the driven rotary member with respect to the drive rotary member to an advanced angle side by supplying working fluid to the advance working chamber and discharging the working fluid from the retard working chamber and also to convert the relative rotational angle of the driven rotary member to a retarded angle side by supplying the working fluid to the retard working chamber and discharging the working fluid from the advance working chamber;

a torsion spring always forcing the driven rotary member in one rotation direction with respect to the drive rotary member by a retaining configuration in which one end of the torsion spring is retained by the driven rotary member and the other end of the torsion spring is retained by the drive rotary member, the torsion spring being shrunk when the driven rotary member relatively rotates with respect to the drive rotary member; and a spring guide accommodating therein at least a part, in an axial direction, of the torsion spring, and at least a part of an outside diameter of the torsion spring, before being installed inside the spring guide, being formed to be greater than an inside diameter of an inner wall of the spring guide, and in a state in which the torsion spring is installed inside the spring guide and an urging force of the torsion spring acting on the driven rotary member with respect to the drive rotary member becomes smallest, the outside diameter of the torsion spring being substantially same as the inside diameter of the inner wall of the spring guide or being smaller than the inside diameter of the inner wall of the spring guide.

8. A method for assembling a variable valve timing control apparatus of an internal combustion engine, the variable valve timing control apparatus having a housing to which a turning force is transmitted from an engine crankshaft and which has shoes on an inner circumferential surface of the housing; a vane rotor having (a) a rotor secured to a camshaft and (b) vanes defining an advance working chamber and a retard working chamber between the adjacent two shoes, the vane rotor relatively rotating to an advanced angle side and to a retarded angle side with respect to the housing by selectively supplying/discharging working fluid to/from the advance working chamber and the retard working chamber; a torsion spring always forcing the vane rotor in one rotation direction with respect to the housing by a retaining configuration in which one end of the torsion spring is retained by the vane rotor and the other end of the torsion spring is retained by the housing, the torsion spring being shrunk when the vane rotor relatively rotates with respect to the housing; and a spring guide accommodating therein at least a part, in an axial direction, of the torsion spring, the method comprising:

fixing the torsion spring whose outside diameter is greater than an inside diameter of an inner wall of the spring guide to a jig;

inserting the torsion spring into the spring guide with the torsion spring twisted in a direction in which the outside diameter of the torsion spring becomes smaller; and detaching the jig from the torsion spring while engaging the one end of the torsion spring with the vane rotor and engaging the other end of the torsion spring with the housing.

* * * * *